United States Patent [19]

Lukianoff

[11] Patent Number: 4,887,396

[45] Date of Patent: Dec. 19, 1989

[54] DISPOSABLE SANDING DEVICE

[76] Inventor: Sergei G. Lukianoff, 2107 Van Ness Ave., San Francisco, Calif. 94109

[21] Appl. No.: 231,498

[22] Filed: Aug. 12, 1988

[51] Int. Cl.[4] ..... B24D 15/00

[52] U.S. Cl. ..... 51/391; 51/394; 51/401

[58] Field of Search ..... 51/391, 394, 400, 401

[56] References Cited

U.S. PATENT DOCUMENTS

| | | | |
|---|---|---|---|
| 2,376,783 | 5/1945 | Kingman | 51/400 |
| 3,918,220 | 11/1975 | Jury et al. . | |
| 4,640,060 | 2/1987 | Lukianoff | 51/391 |
| 4,714,644 | 12/1987 | Rich | 51/401 |

FOREIGN PATENT DOCUMENTS

| | | |
|---|---|---|
| 110562 | 6/1984 | Japan . |
| 122642 | 10/1927 | Switzerland . |
| 530670 | 12/1940 | United Kingdom . |
| 1390825 | 4/1975 | United Kingdom . |

*Primary Examiner*—Robert P. Olszewski
*Assistant Examiner*—Maurina Rachuba
*Attorney, Agent, or Firm*—Donald L. Beeson

[57] ABSTRACT

A disposable sanding device which is fabricated from a block of lightweight, resilient material capable of substantially retaining its shape under applied sanding pressure, has a relatively permanent abrasive surface provided on the faces of the block. Preferably, the abrasive surface on the block faces consist of an abrasive coating which has a built-up in the corner areas of the block to extend the life of the corner sanding surfaces. The block can be provided with an abrasive coated surface specifically contoured to match a particular surface shape to be sanded.

6 Claims, 2 Drawing Sheets

DISPOSABLE SANDING DEVICE

BACKGROUND OF THE INVENTION

The present invention generally relates to sanding devices, and more particularly to a hand-sized, disposable sanding device which can be held in the hand for sanding a variety of surface shapes and configurations.

Common sanding jobs calling for considerable detail work or access to small confined areas, or for the sanding of contoured surfaces, will often require that the surfaces be hand sanded. Heretofore, hand-held sanding devices devised for this purpose consist essentially of a sanding block for holding conventional sandpaper wrapped over the block; by using a sanding block as a sandpaper holder, hand-applied sanding forces on the sandpaper can be increased and more evenly distributed. One such device is disclosed in applicant's U.S. Pat. No. 4,501,096, dated Feb. 26, 1985, wherein a generally triangularly shaped sandpaper holding device provides three different sanding surfaces and corners for accommodating a variety of sanding conditions. The sandpaper wrapped around the faces of this device is held at its ends by means of an angled slot located in one of its faces.

The difficulty with the above-mentioned prior sanding devices is the necessity of installing or wrapping a separate piece of sandpaper around the device. This installation or wrapping process presents some inconvenience to the user, and the paper, if improperly installed, is susceptible to falling off. Also, the device requires the purchase of separate sheets of sandpaper which is a further inconvenience in terms of the amount of supplies needed.

The present invention overcomes the foregoing difficulties of hand-held sanding devices by providing a hand-sized sanding device which eliminates the need for a separate sheet of sandpaper. A sanding device is particularly provided which has its own integral abrasive surfaces and which can be manufactured at a sufficiently low cost to be disposable. The invention further provides a self-contained sanding device that can be conveniently used off-the-shelf to hand sand a variety of standard, contoured or shaped surfaces, such as trim or molding surfaces, and for projecting into exactly defined areas.

SUMMARY OF THE INVENTION

Briefly, the disposable sanding device of the invention includes a hand-sized block of lightweight, resilient material, such as polystyrene or polyurethane, capable of substantially retaining its shape under applied sanding pressure. The block preferably has at least one contoured face, such as an arcuate face or a face shaped to match the shape of standard molding, trim, or the like. While shaped molding and trim are specifically identified herein as possible contoured shapes to which the sanding device of the invention can be designed, it shall be understood that the contoured face of the device can be precisely formed to almost any sandable surface having a uniform cross-sectional shape.

In accordance with the invention, an abrasive surface is relatively permanently provided on at least one or perhaps a number of contoured faces of the sanding block to provide contoured sanding surfaces thereon; it is particularly contemplated that all the faces of the sanding block will be provided with an abrasive surface such that a variety of sanding surfaces and corners can be provided on a single block. The abrasive surface, in accordance with the invention, can be provided by physically securing sandpaper to the block faces. Preferably, however, the abrasive surface is an abrasive coating applied directly to the block.

The invention further provides that the block's abrasive coating can be enhanced in those areas of the block faces which experience the greatest amount of wear, for example, in the area of the corners of the intersecting faces of the block. Alternatively, or in conjunction with providing an enhanced abrasive coating, the density of the block material itself can be enhanced in these areas. By "beefing up" the corners or other areas of the block where greater wear is experienced, the amount of use that can be obtained from the device will be extended.

Therefore, it is seen that the primary object of the present invention is to provide a disposable, hand-held sanding device which is totally self-contained and which can provide an effective and precise tool for hand sanding a variety of difficult to sand surfaces such as contoured surfaces and hard to reach corner surfaces. While it is contemplated that the sanding device of the invention will primarily be used as a hand sanding device, the invention is not so limited in that it would be possible to use the disposable sanding device of the invention in connection with a machine.

DESCRIPTION DRAWINGS

DETAILED DESCRIPTION OF THE ILLUSTRATED EMBODIMENT

Figure 1:
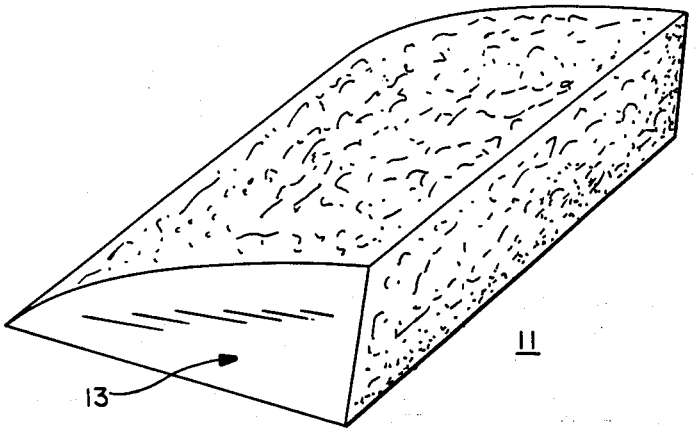
FIG. 1 is a perspective view of a disposable hand sanding device in accordance with the invention.
Figure 2:
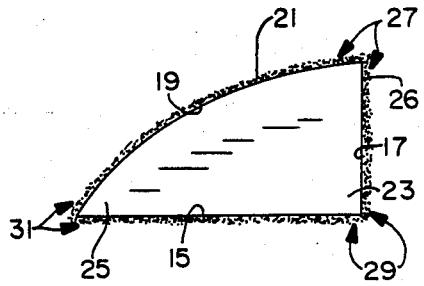
FIG. 2 is an end elevational view thereof.
Figure 3:
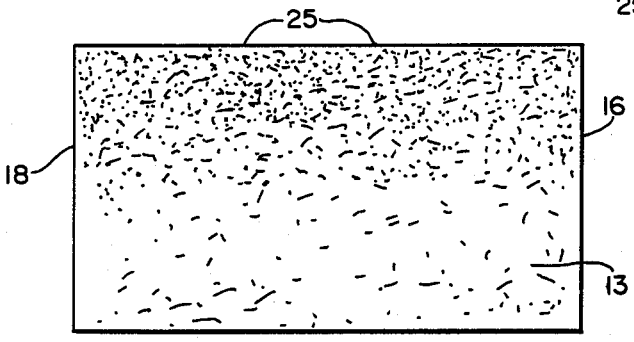
FIG. 3 is a top plan view thereof.
Figure 4:
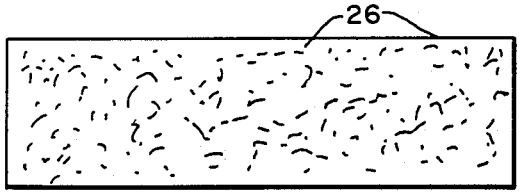
FIG. 4 is a rear elevational view thereof as seen from the right side of FIG. 1.
Figure 5:
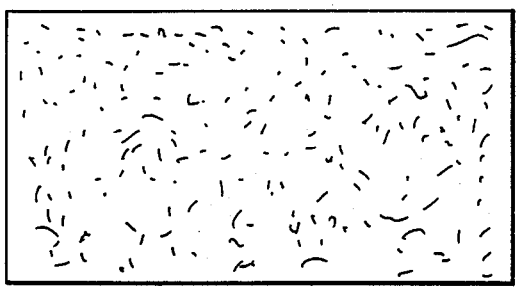
FIG. 5 is a bottom plan view thereof.
Figure 6:
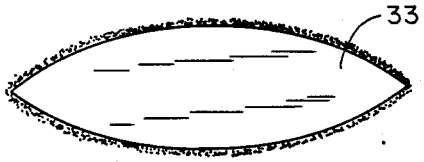
FIGS. 6–10 are end elevation views of a sanding device in accordance with the invention showing different possible cross-sectional shapes therefor.
Figure 7:
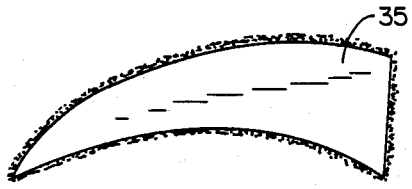
Figure 8:
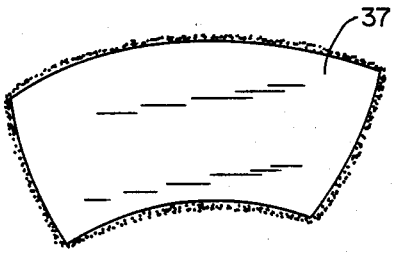
Figure 9:
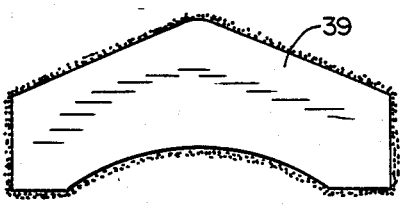
Figure 10:
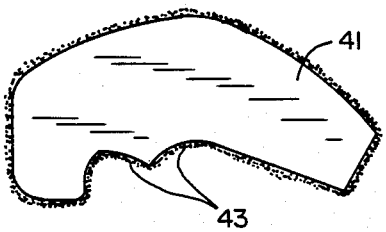

Referring now to the drawings, FIGS. 1–5 illustrate a disposable sanding device, generally denoted in FIG. 1 by the numeral 11, wherein a hand-sized block 13 of a generally triangular cross-sectional shape has two defined ends 16, 18 and three intersecting faces 15, 17, 19, all of which have an abrasive surface 21 relatively permanently provided thereon. The abrasive surface on the faces of the block can be provided by any suitable means, such as wrapping the perimeter faces of the block with a piece of sandpaper cut to the length of the block and securing the sandpaper, such as by a strong adhesive, permanently to the block faces. Preferably, however, the abrasive surfaces will be provided by an abrasive coating which can be applied by any suitable means, for example, through a dipping process, by spraying the coating on the block, or as otherwise described herein, in which case the ends 16, 18 of the block might also be coated.

The block 13 is fabricated of a lightweight, resilient material capable of substantially retaining its shape under normally applied sanding pressures. Generally, a suitable material would be a closed cell plastic material which when slightly deformed under pressure will regain its original shape. Preferably, an approximately three pound polystyrene or polyurethane material will be used to achieve sufficient durability, and yet a low enough production cost to provide true disposability. An abrasive coating can also be applied to a polystyrene or a polyrethane block by simply dipping the block in a suitable solvent, such as acetone, for a brief period of time to achieve a sticky surface, and then by applying an abrasive material directly to it, such as by a gravity feed process.

With reference to the shape of the block illustrated in FIGS. 1–5, the bottom face 15 and side face 17 are seen to be substantially flat surfaces which intersect to provide a substantially right angle corner 23; the top face 19 provides a convex surface having two radii which intersects the two perpendicular flat faces 15, 17 to form two additional block corners 25, 26. It is noted that bottom face 15 is longer than the side face 17 providing two different sized flat sanding surfaces, while the angle of block corner 25 is smaller than the angle of corner 27. By providing a variety of surface sizes, shapes and corner angles, the block will be able to fit into and be used to sand a variety of surfaces and relatively inaccessible corners.

It will be appreciated that certain surfaces of the block shown in FIGS. 1–5 may well experience greater use and wear than other surfaces. Particularly, sanding in confined spaces using any of the three corners 23, 25 or 26 of the block will tend to concentrate greater pressure on the surface areas surrounding these corners compared to sanding on open flat surfaces. To overcome the problem of greater wear in these areas, the abrasive surface in the area of these corners (generally at 27, 29 and 31) are enhanced or built-up to extend the life of the abrasive in these areas. Also, to enhance the durability of the block in the areas of these corners, it is contemplated that the density of the block material itself can be increased. This might be accomplished by providing the block with corner inserts of a higher density material, such as corner insert strips (not shown) made of higher density (e.g. 7 pound) polystyrene or polyurethane.

As illustrated in FIGS. 6–10 of the drawings, it is contemplated that the disposable sanding device of the invention, as described above in reference to the illustrated embodiment of FIGS. 1–5, can be fabricated in a wide variety of shapes having various contoured surfaces to meet different sanding needs. The blocks 33, 35, 37, 39, 41 illustrated in FIGS. 6–7 combine, variously, convex and concave faces, and shaped faces. The shaped faces, for example the shaped face 43 on the block 41 illustrated in FIG. 10, can be selected to specifically match a particular uniformity extending surface shape, such as a length of standard molding. Such shapes can be easily cut from long pieces or "logs" of polystyrene or polyurethane by means of a router. The shaped length of material can thereafter be coated with an abrasive coating and cut into smaller sections of a suitable length to be easily gripped by hand.

Therefore, it can be seen that the present invention is a fully disposable lightweight, and easily fabricated sanding device which has its own abrasive surface, and which will hold up under normal hand-applied sanding pressure. While the embodiments of the invention illustrated in the drawings has been described herein in considerable detail, it is understood that the invention is not intended to be limited to such detail, except as necessitated by the following claims.

What I claim is:

1. A disposable sanding device comprising a block having at least one working face and being fabricated of a lightweight, resilient material capable of substantially retaining its shape under applied sanding pressure, and an abrasive surface relatively permanently provided on said working surface to provide a sanding surface thereon, said block material having a greater density at location where said abrasive surface is likely to experience greater wear.

2. A disposable hand sanding device comprising a block having a substantially uniform three-dimensional cross-sectional shape, said block having at least two intersecting working faces forming a perimeter surface extending entirely around said block and being fabricated of a lightweight resilient material capable of substantially retaining its shape under hand applied sanding pressure, and an abrasive surface comprised of an abrasive coating relative permanently applied to a substantial portion of the perimeter surface of said block to provide a sanding surface thereon, the amount of said abrasive coating being enhanced in the area of said intersecting working faces.

3. A disposable hand sanding device comprising a block having a substantially uniform three-dimensional cross-sectional shape, said block having at least two intersecting working faces forming a perimeter surface extending entirely around said block and being fabricated of a lightweight resilient material capable of substantially retaining its shape under hand applied sanding pressure, said block material being provided with greater density at least one intersection of said working faces, and an abrasive surface relatively permanently provided over a substantial portion of the perimeter surface of said block to provide a sanding surface thereon.

4. A disposable sanding device comprising a block having three intersecting working faces and being fabricated of a lightweight, resilient material capable of substantially retaining its shape under hand applied sanding pressure, said intersecting working faces consisting of one bottom face, one side face narrower than and substantially perpendicular to said bottom face, and one top face extending in a convex curvature between said bottom and side faces, and an abrasive surface comprised of an abrasive coating relatively permanently applied to all of said working faces to provide a sanding surface thereon, said abrasive coating being enhanced in the area of the intersection of at least two of said working faces.

5. A disposable sanding device comprising a block having three intersecting working faces and being fabricated of a lightweight, resilient material capable of substantially retaining its shape under hand applied sanding pressure, said intersecting working faces consisting of one bottom face, one side face narrower than and substantially perpendicular to said bottom face, and one top face extending in a convex curvature between said bottom and side faces, and said block material having a greater density in the area of the intersection of at least two of said faces.

an abrasive surface comprised of an abrasive coating relatively permanently applied to all of said working faces to provide a sanding surface thereon.

6. A disposable hand sanding device comprising a block having a substantially uniform three-dimensional cross-sectional shape, said block having at least three intersecting faces forming the perimeter surface extending entirely around said block, at least two of said faces being intersecting working faces, and said block being fabricated of a lightweight resilient material capable of substantially retaining its shape under hand applied pressure, said block material having greater density at least one of the intersections of said working faces, and an abrasive surface relatively permanently provided on said intersecting working faces to provide a sanding surface thereon, said abrasive surface being provided on all faces forming the perimeter surface of said block whereby all faces of said perimeter surface act as working faces.

* * * * *